United States Patent [19]

Lamb

[11] Patent Number: 4,858,253

[45] **Date of Patent: * Aug. 22, 1989**

[54] MECHANISM FOR EXTENDING AND RETRACTING SWIMMING POOL COVERS

[76] Inventor: Joe H. Lamb, 3500 Hillside La., Salt Lake City, Utah 84109

[ * ] Notice: The portion of the term of this patent subsequent to Mar. 22, 2005 has been disclaimed.

[21] Appl. No.: 825,988

[22] Filed: Feb. 4, 1986

Related U.S. Application Data

[63] Continuation-in-part of Ser. No. 642,347, Aug. 20, 1984, abandoned.

[51] Int. Cl.[4] ..... E04H 3/19

[52] U.S. Cl. ..... 4/502

[58] Field of Search ..... 4/498, 500–503; 254/283, 299, 365; 192/93 A, 51; 242/86.52

[56] References Cited

U.S. PATENT DOCUMENTS

| | | | |
|---|---|---|---|
| 2,754,900 | 7/1956 | Karubonik et al. | 4/502 |
| 2,958,083 | 11/1960 | Shook et al. | 4/502 |
| 3,019,450 | 2/1962 | Karasiewicz | 4/502 |
| 3,050,743 | 8/1962 | Lamb | 4/502 |
| 3,051,232 | 8/1962 | Lamb | 4/500 |
| 3,499,174 | 3/1970 | Carey | 4/500 |
| 4,060,860 | 12/1977 | Lamb | 4/502 |

FOREIGN PATENT DOCUMENTS

| | | | |
|---|---|---|---|
| 274563 | 11/1970 | U.S.S.R. | 192/51 |
| 414587 | 2/1934 | United Kingdom | 254/283 |
| 803632 | 10/1958 | United Kingdom | 254/283 |

*Primary Examiner*—Stephen Marcus
*Assistant Examiner*—Linda J. Sholl
*Attorney, Agent, or Firm*—Richard F. Bojanowski

[57] ABSTRACT

A swimming pool cover apparatus is described whereby the pool cover may be extended and retracted through a power source. The apparatus includes a drive shaft circumscribed by a pair of sleeves. Each of the sleeves may be selectively rotated through a double-dog clutch system connected to the drive shaft. A cover-collecting drum is connected to one of the sleeves. A pair of cord-collecting reels rotatably circumscribe the other sleeve. Controlled rotation of the two cord-collecting reels is achieved through a ratchet and spring-biased pawl system. This system also permits slippage of either of the two cord-collecting reels when the tension on either one of the reels becomes excessive.

17 Claims, 2 Drawing Sheets

MECHANISM FOR EXTENDING AND RETRACTING SWIMMING POOL COVERS

RELATED PATENT APPLICATIONS

This application is a continuation-in-part of patent application Ser. No. 06/642,347 filed on Aug. 20, 1984 now abandoned. The inventor is the same in the above and the instant application.

FIELD OF THE INVENTION

This invention is directed to a pool-covering apparatus and particularly to an extendable and retractable swimming pool cover having a slippage mechanism to prevent accidental damage to the pool cover during retraction.

STATE OF THE ART

The use of swimming pool covers on conventional residential-type swimming pools is well known.

Pool covers are becoming standard equipment for maximizing pool safety as well as reducing unwanted debris from entering the swimming pool when it is not in use. In addition, the use of pool covers minimizes heat loss from pool waters and can also be used to utilize the sun's rays in heating the pool waters during daylight hours.

Most motorized pool-covering apparatuses include a recessed well or a raised housing positioned at one end thereof and having mounted therein an elongated drum fixed to a rotatable shaft which in turn is connected to an electric motor. An impervious, flexible pool cover is secured, at one of its ends, to the cover-collecting drum and is collectable thereon by rotational movement of the drum. The pool cover is extended over the top of the swimming pool by attaching draw cords to both sides of the pool cover as longitudinal extensions thereof and extending the draw cords the length of the pool and around a pulley rotatably fixed to the other side thereof. On most of the pool covers now in use, the draw cord is returned and secured to a collecting reel which is rotatably carried on the same elongated shaft that carries the cover-collecting drum. Normally, one collecting reel is carried on one side of the drum and the other is carried on the other side.

By energizing an electric motor, the draw-cord-collecting wheel is automatically engaged to the rotatable shaft, permitting the reel to rotate and collect the draw cord thereon. Rotation of the shaft and reel draws the pool cover over the length of the swimming pool and thereby covers same. To maintain the sides of the pool cover in close proximity to the side walls of the swimming pool, a slideway channel is preferably fixed to each of the longitudinal side margins of the swimming pool for engaging a bead formed on the lateral side edges of the pool cover. The beads are formed by folding an elongated strip of the pool cover material or some other suitable sheet material, such as canvas or nylon, over a portion of the extended draw cord and securing same thereto by stitching or other means. In so doing, the draw cord, collected on the draw-cord-collecting reel, becomes a longitudinal propagation of the bead. A beaded pool cover of the type just described is disclosed in U.S. Pat. Nos. 3,050,743, 3,019,450, and 3,051,232.

In addition to the above, the pool-covering apparatus normally also includes a braking or drag system such as that described in U.S. Pat. 4,060,860.

This braking system controls the tension applied to the pool cover during the extension and retraction sequence and thereby insures that the cover collected or released from the cover-collecting drum will be uniform and compact during operation.

In U.S. Pat. 4,060,860, a pair of braking systems is required, one for use on each of the collecting reels mounted on either side of the cover-collecting drum.

With the above-described swimming pool apparatuses, sufficient space is required on either side of a swimming pool to accomodate a cord-collecting reel and braking system. In addition, a continuous rotatable shaft is required to pass through the cover-collecting drum to which is attached, at either end, a cord-collecting reel.

In nearly all existing installations, the pool-cover-collecting apparatus is installed either in a housing located in a plane above the swimming pool or in a well located below the top surface of the swimming pool. This requires that certain structural modifications of the pool cover apparatus be made to accomodate the two locations.

The prior art systems, although effective for the purposes designed, are plagued on occasion with damage to the pool cover during the time it is being retracted on the collecting drum. Tearing or ripping of the cover can occur when one side of the cover is collected on the drum at a rate faster than the other side. Eventually, the cover is damaged. To avoid this major problem and to avoid costly repairs of the pool cover, certain modifications of design are mandated.

OBJECTS OF THE INVENTION

To remedy the above problems, it is an object of this invention to provide a motorized swimming pool cover apparatus that may be used either in wells below the surface or in housings located above the surface of the ground.

Another object is to provide a system which is less costly to manufacture and install because both of the cord-collecting reels are mounted on the same side of the cover collecting reel. This system avoids the need of a continuous rotatable shaft passing through the cover-collecting reel. It also avoids the need of two separate braking or drag systems.

Another object of this invention is to provide an apparatus which can be readily used to replace existing apparatuses no matter where the cord- and cover-collecting reels or mechanized means may be located.

Still another object is to provide a system whereby the major operating components, such as collecting reels, braking systems, and power means, can be readily replaced without requiring the services of trained personnel.

A paramount object of this invention is to provide an independent slip-type clutch system whereby the speed of extending each side of the pool cover can be maintained relatively constant and thereby avoid damage to the pool cover.

SUMMARY OF THE INVENTION

The pool-covering apparatus of this invention includes a bracket-support member in which a rotatable shaft is carried. One end of the shaft is mounted to a reversible power means. The other end of the shaft has an elongated cover-collecting drum fixed thereto. Within the side walls of the bracket-support member, intermediate the power means and cover-collecting drum, the rotatable shaft is circumscribed by a sleeve. A pair of spaced-apart cord-collecting reels is rotatably carried on the sleeve. Between the cord-collecting reels, a slippage mechanism comprising in combination a ratchet drum and a springed pawl is fixed to each inner side wall of the cord-collecting reels. When the reels are engaged, the ratchet and pawl combination drives both reels at the same rate of speed. This insures that the pool cover is removed from the collecting drum at a uniform rate. The ratchet and pawl combination also insures that the tension on either side of the pool cover will remain relatively constant during retraction of the pool cover and its collection on the cover-collecting drum. This is accomplished by permitting each reel to rotate independently or, if necessary, at a rate of speed faster than the other when the stress on one side of the cover is substantially greater than the other.

A mechanical feature which distinguishes this system over the prior art systems is that the sleeve are fully rotatable around the shaft and that the cord-collecting reels, which circumscribe one of the sleeves, are freely rotatable around the sleeve. Means are then provided, as more specifically reported below, for connecting the sleeves to the shaft and the cord-collecting reels to the sleeves.

Between the cover-collecting drum and the cord-collecting reels is a double-dog clutch system or a double spiral-jaw clutch system for permitting the reversible power means to drive either the cover-collecting drum or both of the cord-collecting reels. With this type of system, the cord-collecting reel is free-wheeling when the cover-collecting drum has been engaged. When the cord-collecting reels are engaged, the cover-collecting drum becomes free-wheeling.

In order to prevent the cord-collecting reels from rotating uncontrollably and thereby causing the cords being collected thereon to become entangled or to "bird nest," a pair of independent braking or drag systems is provided, one for each of the cord-collecting reels. The drag systems are independently adjustable so that any desired tension can be applied to either of the cord-collecting reels to control their speed of rotation. The braking force is achieved by squeezing or pinching a pair of brake shoes against the side walls of each of the cord-collecting reels. With most automated systems, the braking system alone can provide the control necessary to prevent cord entanglement and to assist in collecting the pool cover in a uniform and even manner. However, when the reels have a common drive means, it is highly advantageous to include a means which will provide increased rotational speed of either of the reels to compensate for pool covers being collected unevenly or nonuniformly on the cover-collecting drum.

A limit switch may also be provided to automatically shut off the power means after the pool cover reaches a pre-selected point in its extension or retraction sequence.

In order to maintain the sides of the pool cover in close proximity to the side walls of a swimming pool, a slideway channel is fixed to each of the longitudinal side margins of the swimming pool for engaging a bead formed on the lateral side edges of the pool cover. The beads are formed by folding an elongated strip of the pool cover material or some other suitable sheet material, such as canvas or nylon, over a portion of the extended draw cord and securing same thereto by stitching or other means. With this technique, the draw cord becomes a longitudinal propagation of the bead. Pulleys are also provided on either end of the pool and near the cord-collecting reels for guiding the draw cords on and off the draw-cord-collecting reels.

DESCRIPTION OF THE PRIOR ART

Figure 3:
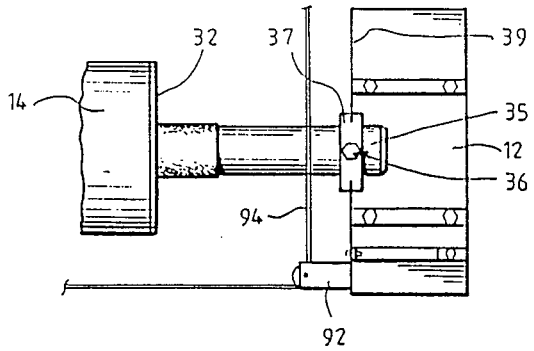
FIG. 3 is a top plan view of the collecting drum's right support member shown in FIG. 1.
Figure 2:
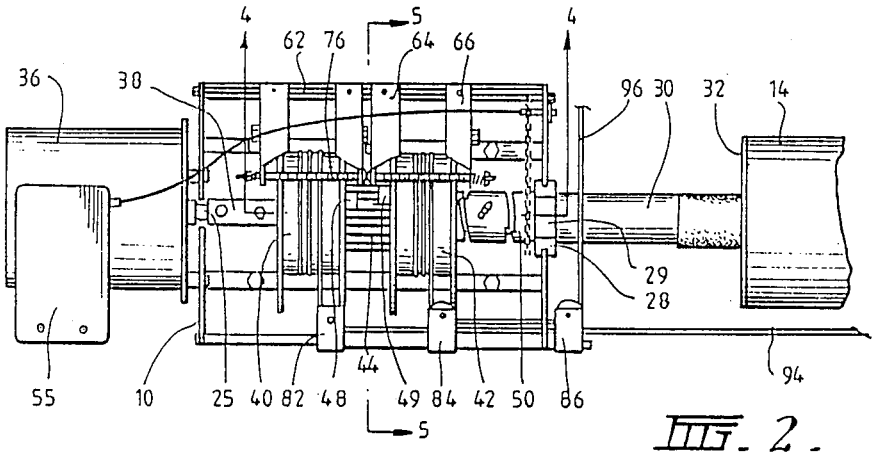
FIG. 2 is a top plan view of the cord-collecting mechanism and the collecting drum's left support member as shown in FIG. 1.
Figure 1:
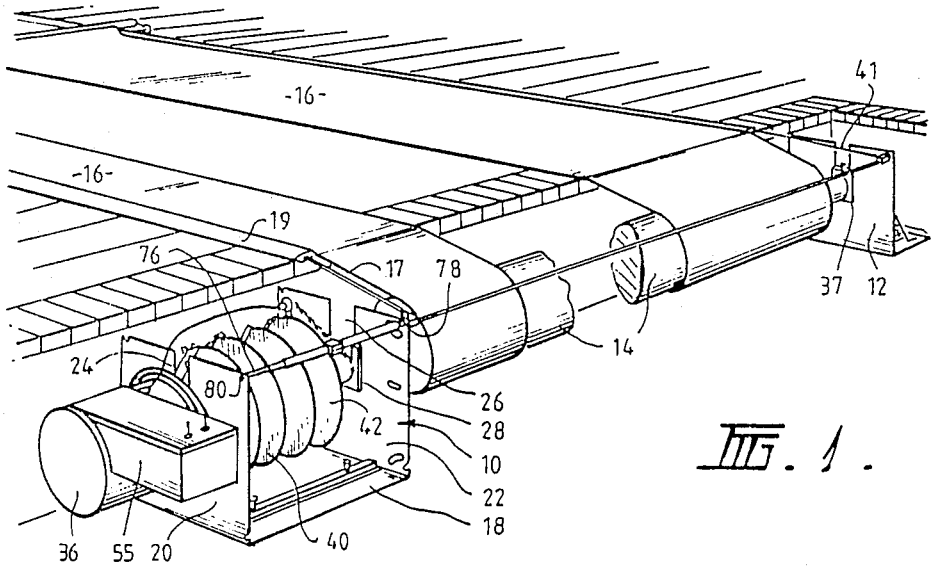
FIG. 1 is a left rear perspective view of the apparatus of this invention, wherein the pool cover is partially extended over a swimming pool, with a portion of the apparatus being cut away for clarity.
Figure 5:
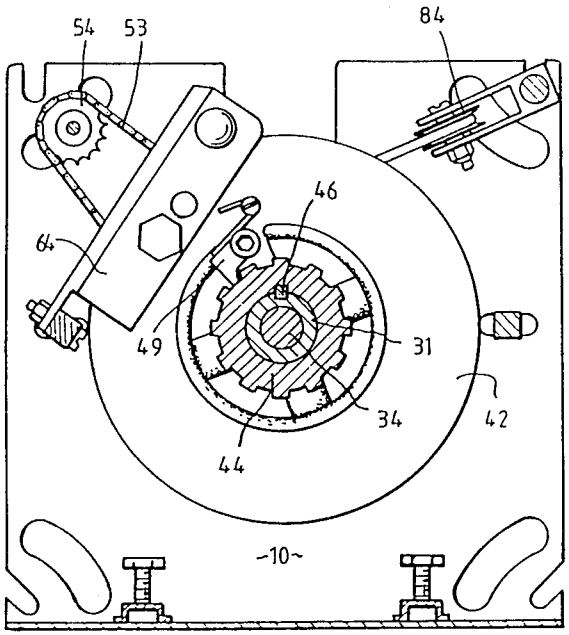
FIG. 5 is a cross-sectional view of the left support member shown in FIG. 2 taken along line 5—5.
Figure 4:
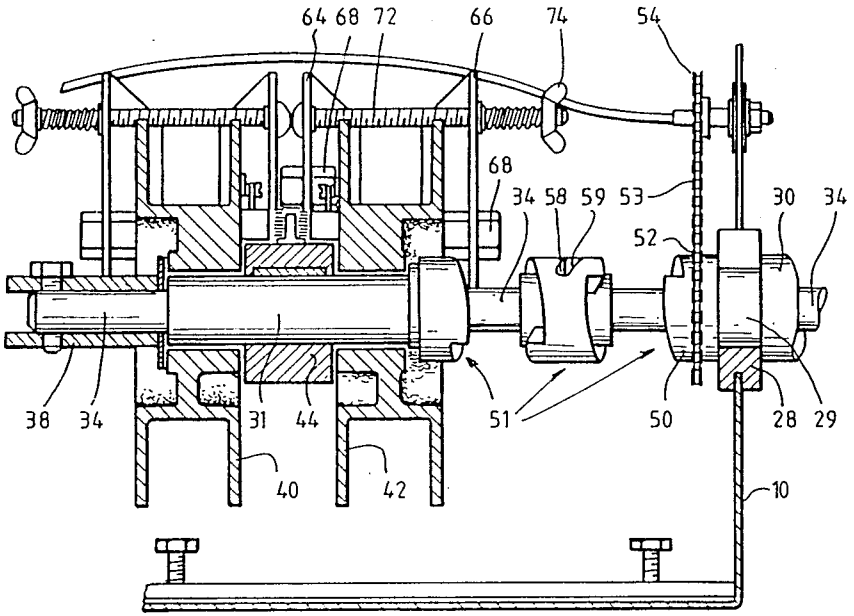
FIG. 4 is a partial vertical cross-sectional view of the left support member shown in FIG. 2 taken along line 4—4, with portions being shown in perspective for clarity, and with the drive shaft being expanded to more clearly show the double clutch dog system.

As depicted in FIGS. 1–5 inclusive and particularly in FIG. 1, the apparatus of this invention includes generally a left collecting-drum support member 10, a right collecting-drum support member 12, and a cover-collecting drum 14 rotatably carried thereon for collecting a pool cover 16 capable of being automatically retracted and extended over a swimming pool. As shown in FIG. 1, the pool cover has beaded side edges 17 for containment in slideway channels 19 fixed to the longitudinal side margins of the swimming pool. The left support member 10 is generally U-shaped and contains a bottom plate 18 and two vertical side plates 20 and 22. The bottom and side plates contain a number of openings and slots for receiving bolts, screws, rods, etc. for fastening, holding, and/or securing other members of the apparatus of this invention. All of the openings or slots shown may not be used at the same time. Only about one-half of the openings and slots shown in the bracket-support member are in use at any one time. The remaining openings and slots are available so that the position of the various members, to be subsequently identified in greater detail, can be modified. This permits the apparatus of this invention to be positioned on either end of the swimming pool or to be positioned in a well below the pool's surface or in a housing above the pool's surface. This results in a bracket-support member capable of being used on nearly any type of existing swimming pool and avoids the need of designing and producing separate systems for different types of existing swimming pools.

The left bracket-support member 10 contains a vertical slot 24 in its side wall 20 and a slightly wider slot 26 in its side wall 22. Slot 24 supports an axle 25 extending from the power means or motor 36 and connected to a drive shaft 34 through a coupling 38. Slot 26 holds a U-shaped nylon bushing 28 for receiving a stepped-down or a reduced-diameter portion 29 of the second hollow shaft 30. The nylon bushing 28 may also consist of a slotted rectangular block having a circular opening with a diameter slightly larger than the diameter of shaft 30.

The right side of the hollow shaft is fitted with a necked-end circular face member 32 for enclosing one end of the hollow cover-collecting drum 14. The other end of the hollow cover-collecting drum 14 is adapted with a similar necked face member 33 which in turn is connected to an end shaft 35. The end shaft 35 is circumscribed by a nylon bushing 37 having a spring-biased cap 36 held within a vertical slot 41 cut into the vertical wall 39 of right support member 12. The above nylon bushing 37 also functions as a means for providing a pre-selected drag for the cover-collecting drum. Fixed to the left side of the hollow second shaft 30 is a drum-driven end member 50 which makes up one of the three elements comprising a double spiral-jaw clutch system or clutch dog system shown generally by the numeral 51. Circumscribing and fixed to the drum-driven end member 50 is a toothed sprocket 52 in communication with a continuous chain 53. The chain overrides a second sprocket 54 which drives a conventional cable-actuated limit switch 55 for automatically shutting off the power means when the pool cover is extended or retracted to a pre-selected point.

Passing through the first and second hollow shafts of sleeves 31 and 30 respectively is a drive shaft 34. This drive shaft 34 extends from the power means 36 to the necked-end circular-face member 32. One end of the shaft 34, as previously stated, is connected to a power means 36 by an intermediate motor coupling 38.

Circumscribing the drive shaft 34, adjacent to the motor coupling 38, is the first hollow shaft or sleeve 31. Freely rotating about the first hollow shaft 31 is a first cord-collecting reel 40 and a second cord-collecting reel 42. It should be noted that the first sleeve 31 rotates freely about drive shaft 34 and that the cord-collecting reels 40 and 42 rotate freely about the first sleeve 31. To each of the inner walls of the cord-collecting reels 40 and 42, spring-loaded pawls 48 and 49 are fixed so that they are in communication with a key-slotted ratchet drum 44. The ratchet drum is secured to the first hollow sleeve 31 by means of a rectangular key 46. The coiled spring on the pawl continually urges the pawl downward so that its tip is in contact with the ratchet drum. Counter-clockwise rotation of the ratchet drum 44 causes both of the cord-collecting reels to likewise turn in unison in a counter-clockwise direction due to the engagement of the pawls in the teeth of the ratchet drum. However, when the pool cover is being retracted, if one of the cords on one of the reels becomes excessively taut during unwinding, such reel's rotational speed will increase by slippage of that reel's pawl over the ratchet drum. This releases the increased tautness and insures that the tension on both cords will remain relatively constant. In essence, first sleeve 31 is selectively linked to the cord-collecting reels 40 and 42 by means of the ratchet-and-pawl system 44, 48, and 49.

As previously indicated, one end of the rotatable shaft 34 is connected to a power means 36 which preferably is a reversible electric motor of about one-quarter horsepower and a gear-speed reducer capable of producing from about 18 to 60 revolutions per minute. Power is transmitted from the electric motor to either the cord-collecting reels or the cover-collecting drum by a spiral-jaw clutch system or a clutch dog system 51. This clutch system comprises three major elements (FIG. 4): a drum-driven end member 50 fixed to the second hollow shaft 30, a reel-driven end member 56 fixed to the first hollow shaft 31, and a double driver member 57 having a diagonal cam slot 58 or shifting collar. The double driver member 57 is fixed to shaft 34, to provide lateral movement of the shifting collar along shaft 34, by a shear pin 59. When viewing shaft 34 from right to left, the clockwise rotation of shaft 34 causes the collar to slide to the right and engage the drum-driven member 50 and thereby cause clockwise rotation of the cover-collecting drum. During the clockwise rotation the pool cover is retracted and collected on the cover-collecting drum.

When the shaft is rotated in a counter-clockwise direction the shifting collar moves laterally to the left and engages the reel-driven member 56, causing the reels to rotate in a counter-clockwise direction. During rotation of the reels, the cords extending out from the beads of the pool cover are collected on the reels pulling the cover over the swimming pool.

During extension and retraction of the swimming pool cover, it is desirable to maintain a pre-selected tension on the pool cover through the draw cords by applying an adjustable drag or braking force to each of the cord-collecting reels. This is accomplished by the braking means 60 and 61 best depicted in FIGS. 2 and 4. Since the braking means are identical, only braking means 61 will be described in detail.

The braking means 61 includes a rotatable shaft 62 loosely connected to the side walls 20 and 22 (FIG. 2) of left mounting bracket 10. Pivotally fixed to shaft 62 is a pair of elongated arms 64 and 66 having brake shoes 68 and 70 fixed to each of the inner walls of arms 64 and 66. These brake shoes are positioned so that they are facing the outer walls of the cord-collecting reel 42. A spring-loaded threaded bolt 72 passes through the top portion of the elongated arms. The end of the threaded bolt is adapted to receive a wing nut 74 which when turned clockwise urges the arms and brake shoes against the outer walls of the cord-collecting reels. This type of braking system is reported in U.S. Pat. 4,060,860 and is hereby incorporated herein by reference.

On the opposite side of the braking system (FIG. 2) is a notched rod 76 adapted for communication with a pair of slots cut into the top section of side walls 20 and 22 of support bracket 10. On this rod are positioned three pulleys 82, 84, and 86 adapted to swing freely around the notched rod 76. The pulleys are spaced from each other by spacers 88 and 90 which align pulleys 82 and 84 in a plane with each of the cord-collecting reels 40 and 42. The third pulley 86 is aligned outside of the bracket walls. A fourth pulley 92 (FIG. 3) is positioned on the right support member 12. Pulleys 82 and 84 are responsible for directing the draw cords 94 and 96, which ar extensions of beads (not shown) of the swimming pool cover, toward the cord-collecting reels. Pulleys 82 and 84 are responsible for directing the draw cords about the cord-collecting reels. Each end of the respective draw cords is fixed to the collecting reels by any suitable means. A pair of return pulleys (not shown) is positioned on the other end of the pool to permit the pool cover to be fully extended during the covering process.

Although certain preferred constructions have been illustrated and described herein, it should be understood that various changes may be made without departing from the inventive concepts particularly pointed out and distinctly claimed in the claims set forth below.

I claim:

1. An apparatus for extending and retracting a cover comprising:

a support member, a rotatable drive shaft carried on said support member, a first and second tubular sleeve each circumscribing said drive shaft and being independently freely rotatable, a cover-collecting drum, a means for fixing said cover-collecting drum to one end of said second tubular sleeve, a pair of cord-collecting reels circumscribing and being free wheeling about said first tubular sleeve, a means for selectively linking said pair of cord-collecting reels to said first tubular sleeve, and means fixed to said drive shaft for permitting rotation of said first tubular sleeve when said drive shaft is rotated in one direction and for permitting rotation of said second tubular sleeve when said drive shaft is rotated in other direction.

2. The apparatus of claim 1 wherein the means for permitting rotation of said first tubular sleeve and said second tubular sleeve comprises a double-dog clutch system.

3. The apparatus of claim 2 wherein said double-dog clutch system includes a drive element fixed to said drive shaft and a pair of driven elements, one each fixed to said first and second tubular sleeves.

4. The apparatus of claim 3 wherein said driver element is slidably fixed to said drive shaft to permit axial movement and to thereby engage one of said driven elements when said drive shaft is rotated in one direction.

5. The apparatus of claim 1 wherein said means for selectively linking said pair of cord-collecting reels to said first tubular sleeve is through a ratchet drum fixed to said first tubular sleeve and a pawl fixed to each of the inner walls of said cord-collecting reels for communicating with said ratchet drum.

6. The apparatus of claim 5 wherein said pawls are spring loaded.

7. The apparatus of claim 5 wherein said ratchet drum is fixed to said first tubular sleeve by means of a key.

8. The apparatus of claim 3 wherein said driven elements are removably fixed to said first and second tubular sleeves.

9. The apparatus of claim 1 including a means for producing a drag on said pair of cord-collecting reels.

10. The apparatus of claim 9 wherein said drag is adjustable.

11. The apparatus of claim 9 including a plurality of pulleys loosely mounted to said support member for directing a cord onto said cord-collecting reels.

12. The apparatus of claim 11 including a reversible power means for rotating said drive shaft.

13. The apparatus of claim 12 including a means for automatically turning off said power means after a preselected number of rotations of said drive shaft.

14. The apparatus of claim 1 including a swimming pool cover designed and adapted to be collected on said cover-collecting drum.

15. The apparatus of claim 13 wherein said swimming pool cover has side edges having cords propagating therefrom.

16. The apparatus of claim 14 wherein said cords are fixed to said cord-collecting reels at one of their ends.

17. The apparatus of claim 15 including slideway channels for holding the edges of the pool cover to the sides of a swimming pool.

* * * * *

UNITED STATES PATENT AND TRADEMARK OFFICE

CERTIFICATE OF CORRECTION

PATENT NO. : 4,858,253

DATED : August 22, 1989

INVENTOR(S) : Joe H. Lamb

It is certified that error appears in the above-identified patent and that said Letters Patent is hereby corrected as shown below:

In column 4, line 26, change "PRIOR ART" to

--ILLUSTRATED EMBODIMENT--

Signed and Sealed this

Sixteenth Day of March, 1993

*Attest:*

STEPHEN G. KUNIN

*Attesting Officer*

*Acting Commissioner of Patents and Trademarks*